United States Patent [19]

Greenberg

[11] Patent Number: 4,696,625

[45] Date of Patent: Sep. 29, 1987

[54] EJECTOR AND METHOD OF FABRICATION

[76] Inventor: Dan Greenberg, 4 Rehov Haganim, Kiryat Bialik, Israel

[21] Appl. No.: 824,165

[22] Filed: Jan. 30, 1986

[30] Foreign Application Priority Data

Feb. 8, 1985 [IL] Israel ..... 74282

[51] Int. Cl.[4] ..... F04F 5/00; B65B 31/04; B21D 53/00

[52] U.S. Cl. ..... 417/174; 29/157 R; 29/428; 141/65; 417/179; 264/299

[58] Field of Search ..... 29/157 R, 428; 141/7, 141/65; 417/174, 179; 137/602, 888; 264/299

[56] References Cited

U.S. PATENT DOCUMENTS

| | | | |
|---|---|---|---|
| 3,022,743 | 2/1962 | Engholdt | 29/157 R X |
| 3,959,864 | 6/1976 | Tell | 29/157 R X |
| 4,554,956 | 11/1985 | Greenberg | 29/157 R X |

*Primary Examiner*—Howard N. Goldberg
*Assistant Examiner*—Ronald S. Wallace
*Attorney, Agent, or Firm*—Renner, Otto, Boisselle & Lyon

[57] ABSTRACT

An ejector device consists of a number of ejector units each of which includes a suction chamber. The individual units are positioned in a common housing. For making the ejector the housing is produced and the suction chambers are produced therein. These latter are four sided recesses. The holes are made in the partitions between the chambers and in the walls of the housing and nozzles are fixed in these holes. In a further step a flexible cover is placed on the open sides of the chambers. There are openings in that cover. It is covered by a rigid plate with an opening and a second flexible cover is placed on the plate. Finally a second housing is secured to the assembly. Inlet and outlet ports are provided in the second housing.

7 Claims, 3 Drawing Figures

EJECTOR AND METHOD OF FABRICATION

FIELD OF THE INVENTION

The present invention relates to a new construction of an ejector device and a method for producing same, and more particularly to an assembly of such devices in which that assembly has a large evacuation capacity in combination with a maximal negative pressure.

There are known a number of such ejector devices, e.g. the one described in U.S. Pat. No. 3,959,864. The advantages of the method described in that Patent Specification are apparent, but nevertheless there are still some disadvantages in the device according to that patent.

To overcome these disadvantages, there has already been suggested in my U.S. Pat. No. 4,554,956 a new method for producing such an ejector device. One of the objects of the invention described in my said Patent was to provide a modular ejector device which can be duplicated or triplicated when a greater evacuation capacity is needed. However, practice showed that after assembling more than four units the evacuation capacity is not increasing as expected, which is due to the limited size of the evacuation inlet of the third and fourth units. Moreover in some cases when a great evacuation capacity is needed thus requiring a number of units, the space which is needed for such an assembled ejector is large and not available. In dealing with these disadvantages there has already been suggested in my U.S. Patent Application Serial No. 602,374 a new method and device for producing such an ejector device. Said device has a cylindrical configuration, a matter which in some cases might be a drawback.

OBJECT OF THE INVENTION

It is thus the object of the present invention to provide a device and method for producing an ejector device which, on the one hand, will have a great evacuation capacity, and on the other will be of relatively small size. Moreover, the evacuation inlet will be of sufficient size with the option of enlarging same if needed.

SHORT SUMMARY OF THE INVENTION

The invention is characterized by a method for producing an ejector device with several ejectors assembled in a first common ejector housing part comprising a multiple number of suction chambers with one side left open, an inlet opening for a pressure medium being provided at that housing part and a plurality of ejector nozzles in each suction chamber being positioned co-axially one after the other, one of said chambers being provided with an evacuation inlet port (as will be defined herein), the method comprising the steps of producing the housing part, forming therein the said suction chambers with substantially quadratic or rectangular outline, drilling holes through the walls of the housing part and said chambers for accommodation of nozzles, inserting ejector nozzles into said holes, covering the said open side of the housing part by means of a flexible cover provided with openings, placing a plate member with opening thereon and a second flexible cover on top of which a second housing part is secured by means of screws to the said first housing; said second housing part being provided with an inlet and an outlet port.

The invention will now be described in detail with reference to the attached drawings, in which:

FIG. 1 is an exploded perspective view of the ejector according to the invention, while

Figure 1:
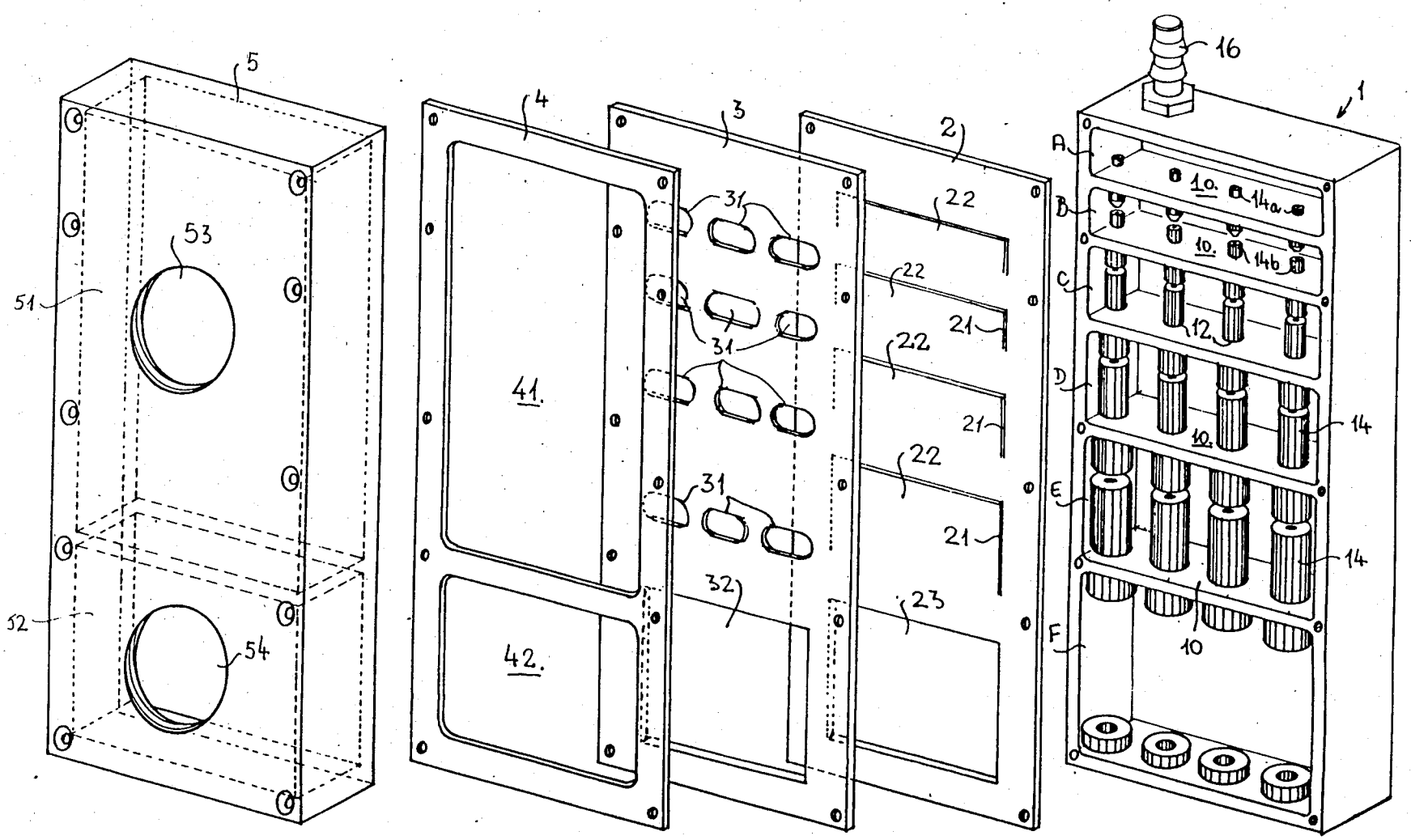

Turning first to FIG. 1, the new ejector comprises:

(1) a housing part 1
(2) a flexible cover 2
(3) a plate member 3
(4) seal member 4, and
(5) a second housing part 5.

In the example shown, there are provided a number of suction chambers: A, B, C, D, E, F, separated from one another by partitions 10. The housing part 1 and the said partitions may be produced as an integral body e.g. by moulding—if the ejector is made of plastic—or by C.N.C. (i.e., computer numerical control), if made of metal. In the partitions 10 holes 12 are provided into which a plurality of nozzles 14 in each chamber are fixedly inserted. Said nozzles 14 are arranged in co-axial rows. Housing part 1 is further provided with a pressure inlet 16. The flexible cover 2 is provided with inverted U-shaped cuts 21 which form flaps 22 and a full cut-out 23.

In the plate member 3 there are apertures 31 and 32. The seal 4 is provided with openings 41,42 each of which is in register with a portion of housing part 1 and thus divides the housing into two parts. Finally the second housing part 5 is correspondingly divided into two chambers 51 and 52, each of which has an opening 53,54 respectively. The ejector assembly thus far described operates in the following manner: Inlet 16 is connected to a source of pressurized air, e.g. a compressor. Pressurized air (or another fluid) is pressed into chamber A, it will flow out of chamber A through the nozzles **14*a* into chamber B and through nozzles 14*b* into chamber C and so on until chamber F. The flow of air will take along with it air from the chamber it passes through, so that the intitial quantity of pressurized air together with the air brought with it will flow out from chamber F through the openings 23,32 and 42 in members 2, 3 and 4 into chamber 52 in the second housing 5 and out through outlet 54. The quantity of flowing air through the nozzles will increase from chamber to chamber and thus the sub-pressure in the chambers will become greater. When for example, the sub-pressure in chamber D is low, air will be sucked into respective chambers via cuts 21 and flaps 22 in member 2 and openings 31 and 41 in members 3 and 4, and finally from chamber 51 in housing 5 which has the opening 53**, i.e., such opening acts as a suction inlet.

Figure 3:
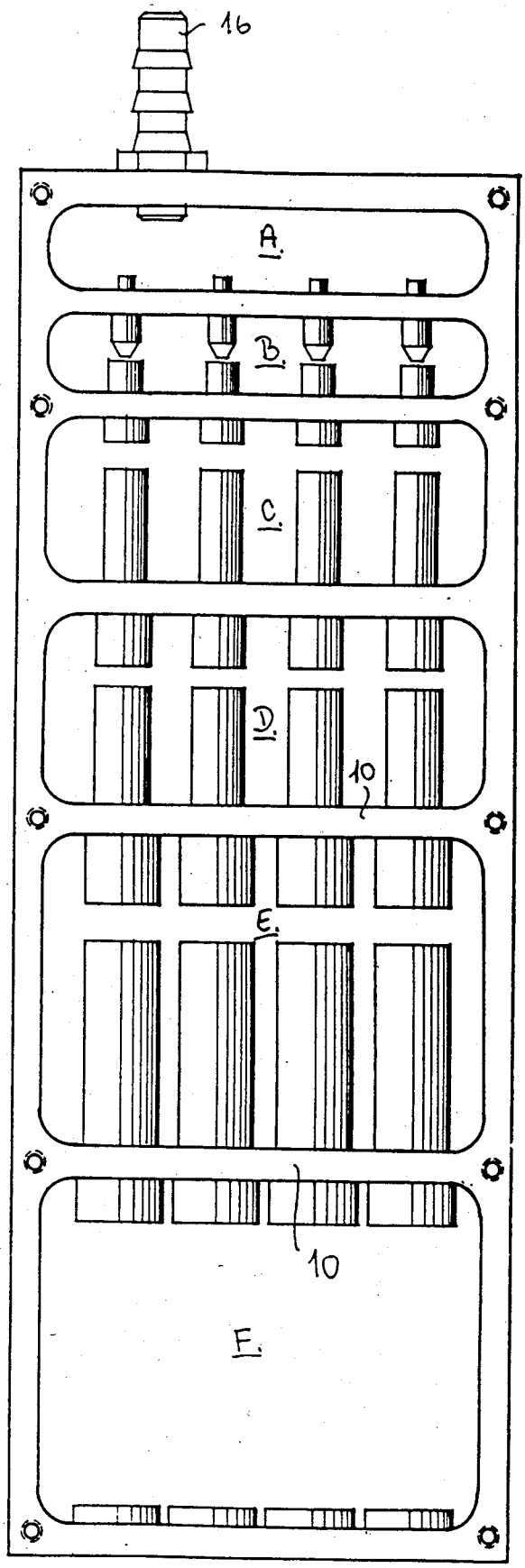
FIG. 3 is an elevational view of the housing, of the first kind.

As can be seen in FIGS. 1 and 3, the distance between co-axial nozzles increases in the direction of flow and so does the diameter of the individual nozzles, a matter which is subject to the efficiency degree to be obtained.

Figure 2:
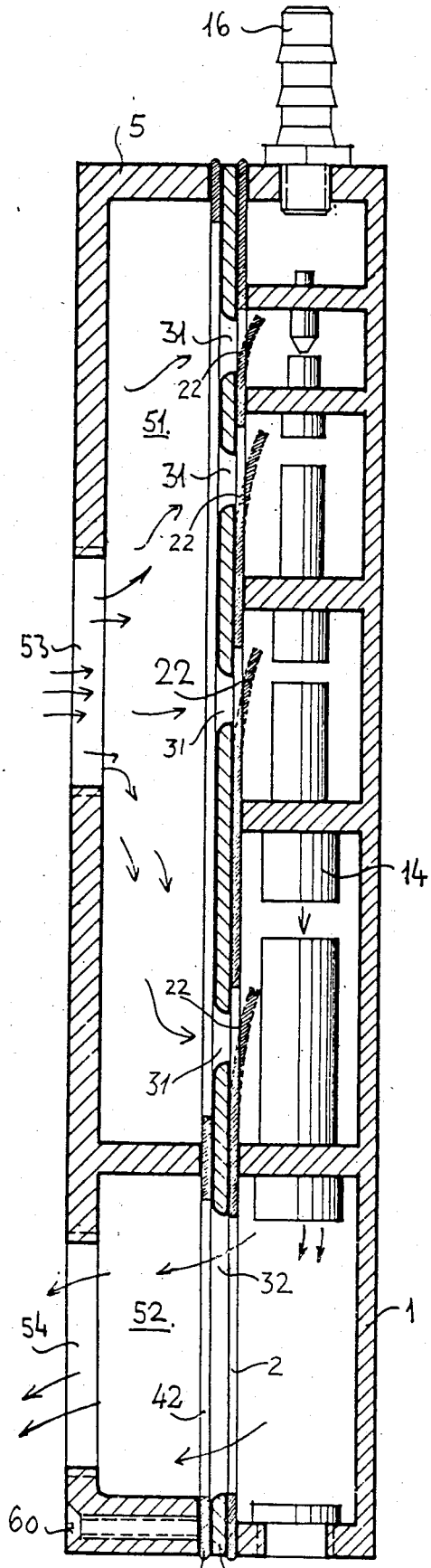
FIG. 2 is a lateral sectional view of one of the partitions of the ejector.

The ejector is assembled as follows: housing 1 is covered with flexible cover 2, flaps 22 correspond with chambers B, C, D and E. On top of cover 2, plate 3 is placed, likewise openings 31 corresponds with said chambers. Seal 4, which is placed on plate 3 has opening 41 which corresponds with openings 31, cuts 21 and chambers B, C , D, E while openings 23, 32 and 42 correspond with chamber F (see FIG. 2), finally the second housing part 5 is placed on top of seal 4 and by means of screws 60 the whole assembly is fastened together.

Flaps 22 which cover openings 31 act as a one-way valve for the air which is sucked in through inlet 53.

The overall evacuation capacity of the above can be determined by increasing (or diminishing) the number of nozzles.

At the beginning of the operation all four suction chambers (B, C, D, E) participate, but as the negative pressure increases, openings 31 which correspond with chambers E, D, C, close by means of flaps 22, thus the device operates through opening 31 which correspond with chamber B.

It can be seen that by employing the device according to the invention the following advantages are achieved:

(1) Easy to manufacture and assemble its parts and to repair—if necessary.

(2) The inlet 53 and outlet 54 may be connected to a system of pipes to avoid contamination.

(3) Due to its modularity parts may be added or omitted.

I claim:

1. Method of producing an ejector device with several ejectors assembled in a first common ejector housing part comprising a multiple number of suction chambers with one side left open, an inlet opening for a pressure medium, a plurality of ejector nozzles in each suction chamber being positioned co-axially one after the other, one of said suction chambers being provided with an evacuation inlet port, the method comprising the steps of producing the first housing part, forming therein the suction chambers, forming holes in the walls of the first housing part and said chambers for accommodation of the ejector nozzles, inserting the ejector nozzles into said holes, covering the open side of the first housing part by means of a flexible cover provided with flaps, placing on top of the flexible cover a plate member with openings, placing a seal member on top of the plate member, placing a second housing part having an inlet port and an outlet port on top of the seal member, and securing the first housing part to said second housing part.

2. The method according to claim 1, wherein the first housing part is plastic and is produced by being integrally moulded in one piece.

3. The method according to claim 1, wherein the first housing part is metal and produced by computer numeral control.

4. The method according to claim 1 wherein said step of forming the holes in the walls of the first housing part for accommodation of the ejector nozzles is accomplished by drilling.

5. An ejector device comprising a first housing part having multiple suction chambers with one side of each of said suction chambers left open, a plurality of ejector nozzles in each suction chamber positioned co-axially one after the other, a flexible cover having flaps abutting said first housing part and covering the open side of said suction chambers, a plate member having multiple openings covering said flexible cover, a seal member covering said plate member, a second housing part having an inlet port and an oulet port covering said seal member, and fastening means for securing said first housing part to said second housing part.

6. An ejector device as set forth in claim 5 wherein the first housing part is integrally moulded plastic.

7. An ejector device as set forth in claim 5 wherein said fastening means comprises screws.

* * * * *